United States Patent [19]

MacLeish et al.

[11] Patent Number: 5,046,539

[45] Date of Patent: Sep. 10, 1991

[54] AUTOMATIC FLUID DISPENSER FOR MULTI-WELLED DISH

[75] Inventors: Peter MacLeish, New York; Michael Chen, Elmhurst; Henry Shao, Sunnyside, all of N.Y.

[73] Assignee: The Rockefeller University, New York, N.Y.

[21] Appl. No.: 357,897

[22] Filed: May 26, 1989

[51] Int. Cl.[5] ..... B65B 3/04

[52] U.S. Cl. ..... 141/234; 422/100; 73/863.92; 141/130; 141/21; 141/25; 141/27

[58] Field of Search ..... 141/129, 130, 167, 168, 141/178, 234, 248, 21, 23, 25, 27; 422/100, 102; 73/863.91, 863.92, 864

[56] References Cited

U.S. PATENT DOCUMENTS

| | | | |
|---|---|---|---|
| 3,151,639 | 10/1964 | Allington | 141/130 X |
| 3,221,781 | 12/1965 | Forsstrom | 141/130 |
| 3,437,447 | 4/1969 | Harmon | 141/130 X |
| 3,687,632 | 8/1972 | Natelson | 422/100 |
| 3,935,883 | 2/1976 | Stach et al. | 141/27 |
| 4,478,094 | 10/1984 | Salomaa et al. | 422/100 X |
| 4,586,546 | 5/1986 | Mezei et al. | 422/100 X |
| 4,681,742 | 7/1987 | Johnson et al. | 422/102 |

FOREIGN PATENT DOCUMENTS

| | | | |
|---|---|---|---|
| 2037427 | 3/1971 | Fed. Rep. of Germany | 141/130 |
| 2011239 | 7/1980 | Fed. Rep. of Germany | 422/100 |

*Primary Examiner*—Ernest G. Cusick

*Attorney, Agent, or Firm*—Wyatt, Gerber, Burke & Badie

[57] ABSTRACT

A fluid dispensing system comprises a first linearly translatable plate and a second linearly translatable plate mounted below the first plate at 90 degrees relative thereto, the first plate being displaceable in one direction and the second plate being displaceable in another direction, said dispenser including an overhead fluid dispenser for dispensing calibrated amounts of fluid into each well of a multi-welled dish wherein the wells are spaced apart in rows and columns.

13 Claims, 3 Drawing Sheets

AUTOMATIC FLUID DISPENSER FOR MULTI-WELLED DISH

FIELD OF THE INVENTION

This invention relates generally to an apparatus for precise fluid dispensation. It is particularly related to an automatic fluid dispenser for dispensing predetermined and precise amount of fluid into the wells of a multi-welled dish of the type usually employed for carrying out immunoassay and biochemical reactions.

BACKGROUND OF THE INVENTION

In many chemical and biochemical studies, it is frequently necessary to distribute the reagent or solution precisely and rapidly to multiple containers. In one presently used laboratory system, the reagent is dispensed through multiple pipettes arrangement and corresponding multiple tubings. This system is not only cumbersome and slow to operate, but also presents a sterility problem since each time a different reagent flows through the pipette, it must be thoroughly sterilized for different reagent dispensation. Where rapidity and accuracy of measurement or analyses are required, such systems are grossly inadequate.

Another prior art system for transferring liquid between containers is described in U.S. Pat. No. 3,687,632. The system described in this patent comprises a flat movable platform for receiving two trays, each provided with a row of test tubes or containers. This system is designed so that an accurately measured amount of liquid is transferred from a first group of containers in a row on one tray, to a second group of containers in a row on the second tray, while a reagent is being added during the transfer. The platform moves linearly to properly position each container for aspirating fluid from a container and transferring to another container. The movement of the platform is controlled by a rack and pinion.

In another prior art patent, i.e., U.S. Pat. No. 4,681,742, there is described a fluid dispensing machine for transferring liquid to and from the wells of an assay tray. The machine includes a horizontally translatable table and a vertically translatable head assembly. Translation of the horizontal table is provided by a stepper motor through a pinion gear connected to the motor and to a rack. Translation of the head assembly is provided by a stepper motor by a similar pinion gear-rack arrangement. A plurality of liquid dispensing manifolds are used for dispensing liquid into the wells of the assay tray.

Thus, as it can be seen, the prior art fluid dispensing systems used to carry out biochemical reactions are difficult to construct, cumbersome to operate, require complicated sterilization procedures and, in general, are very expensive.

Accordingly, it is an object of this invention to provide a fluid dispenser for use in conducting biochemical reactions, immunoassay and other chemical reactions wherein the dispenser is characterized by its simplicity of construction and more efficient operation compared to the prior art systems.

It is a further object of this invention to provide an automatic fluid dispenser which is capable of introducing fluid through a single pipette into the wells of a multi-welled dish or assay tray.

It is yet another object of this invention to provide such automatic fluid dispenser which dispenses predetermined and precise amounts of fluid rapidly using a single disposable tubing and pipette, thus eliminating the need for sterilization or at least simplifying sterility procedures.

The foregoing and other features of the present invention will be more readily appreciated from the ensuing detailed description of the invention by reference to the accompanying drawings.

SUMMARY OF THE INVENTION

The present invention contemplates a fluid dispensing system for dispensing precise and predetermined quantities of fluid into a receptacle such as a multi-welled dish or assay tray. The system comprises a first linearly translatable plate and a second linearly translatable plate mounted transversely below the first plate. In one embodiment, the plates are disposed at 90 degrees relative to each other. Each plate has a means, such as a reversible stepper motor, associated therewith for displacing said plate. The stepper motor associated with the first plate is adapted to displace said plate in one direction, e.g., in the horizontal direction, and the stepper motor associated with the second plate is adapted to displace said plate in another direction, e.g., the perpendicular direction. A multi-welled dish is secured to the upper surface of the first plate and a fluid dispensing means such as a pipette is positioned above the multi-welled dish in register with the first well to be filled with fluid from the fluid dispenser. The system also comprises a syringe which is connected to the pipette through plastic tubing. A stepper motor is operatively associated with the syringe to displace the plunger in the syringe thus forcing air or another gas under pressure through the tubing into the pipette in order to dispense a calibrated amount of fluid into each well of the multi-welled dish.

BRIEF DESCRIPTION OF THE DRAWINGS

In the drawings, wherein like reference numerals designate like parts.

DETAILED DESCRIPTION OF THE INVENTION

Figure 1:
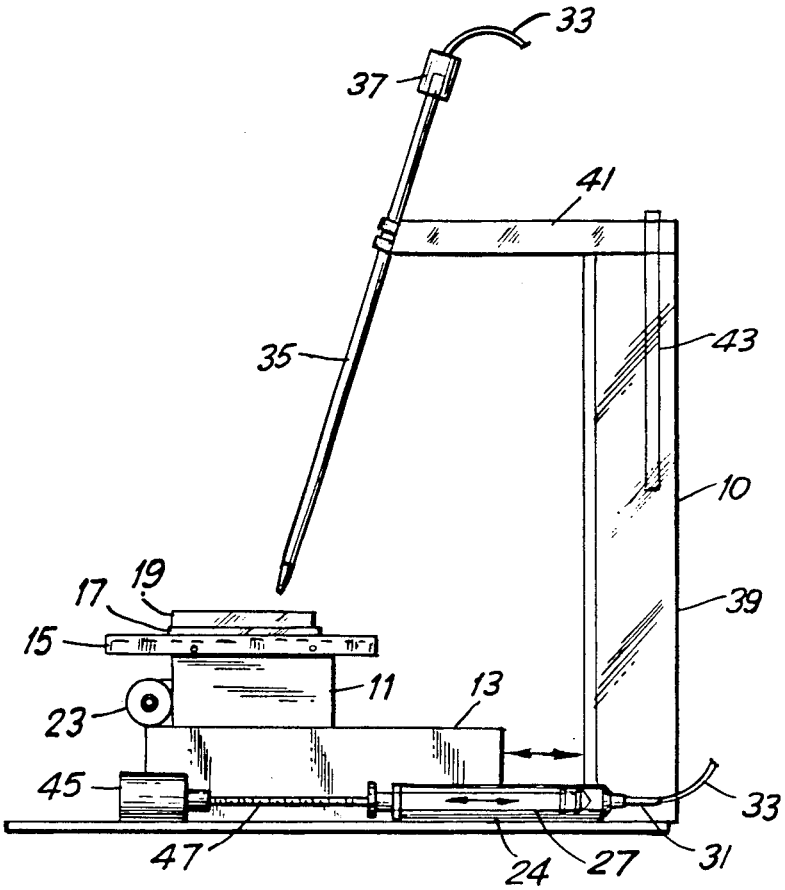
FIG. 1 is a front elevational view of the fluid dispenser system of this invention.
Figure 2:
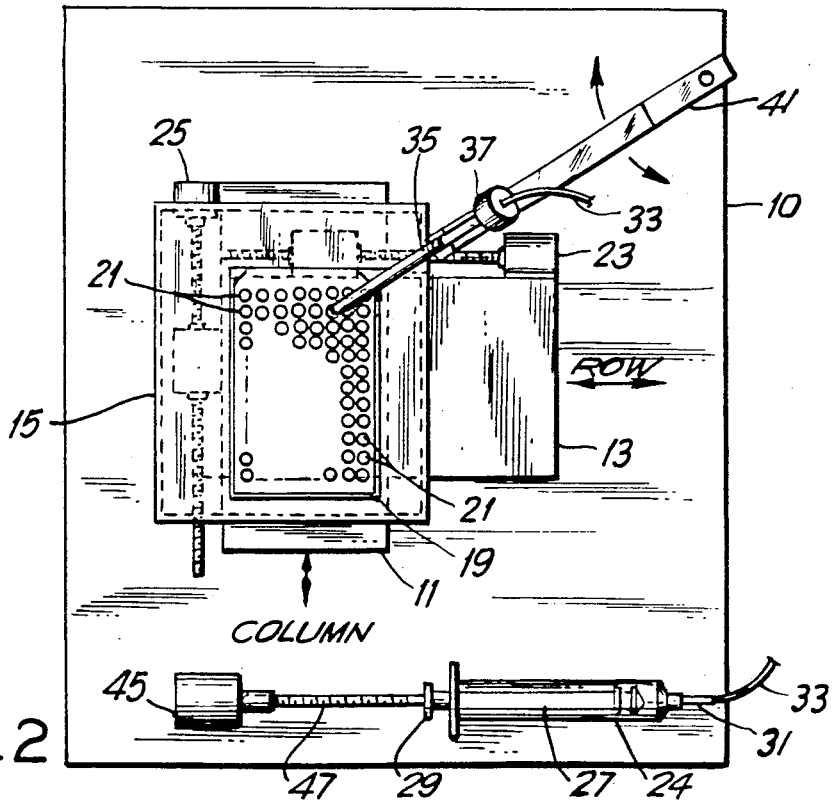
FIG. 2 is a top view of the fluid dispenser system shown in FIG. 1, illustrating a multi-welled dish used to carry out the biochemical reactions.
Figure 3:
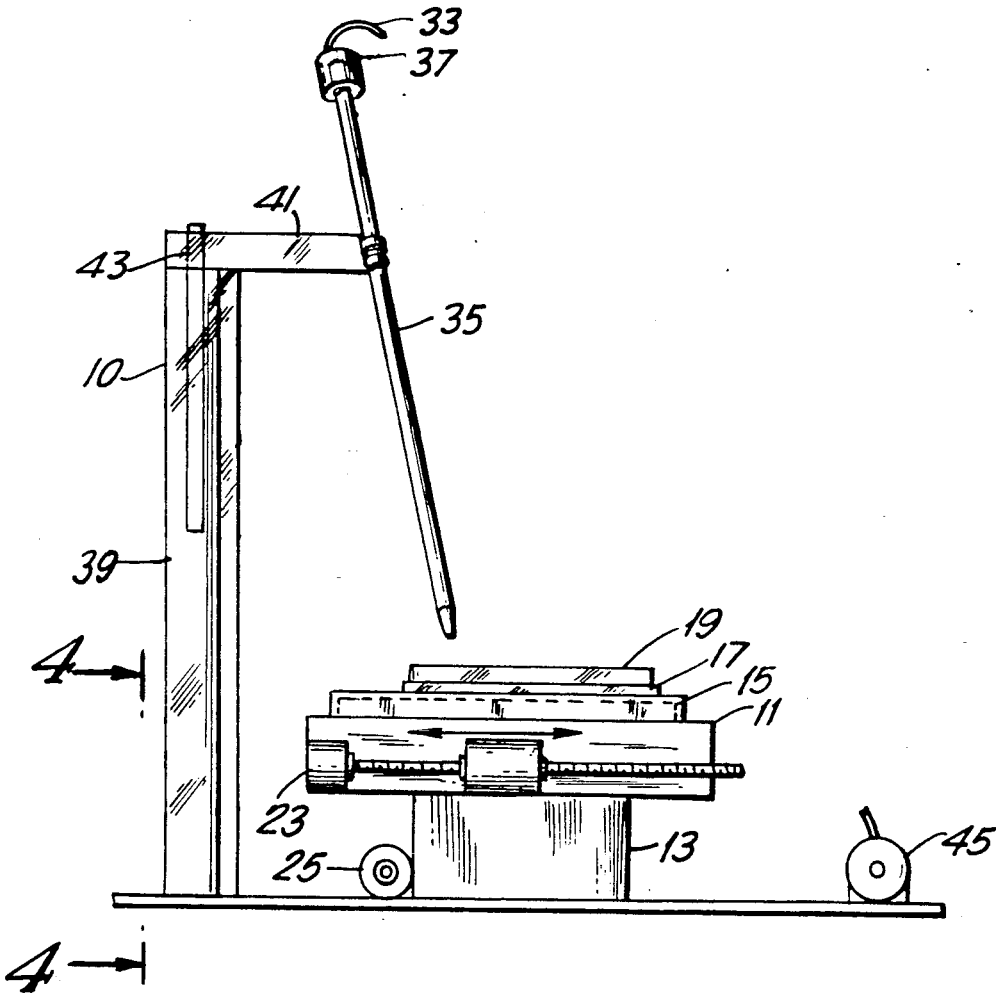
FIG. 3 is a side elevational view of the fluid dispenser system shown in FIG. 1.
Figure 4:
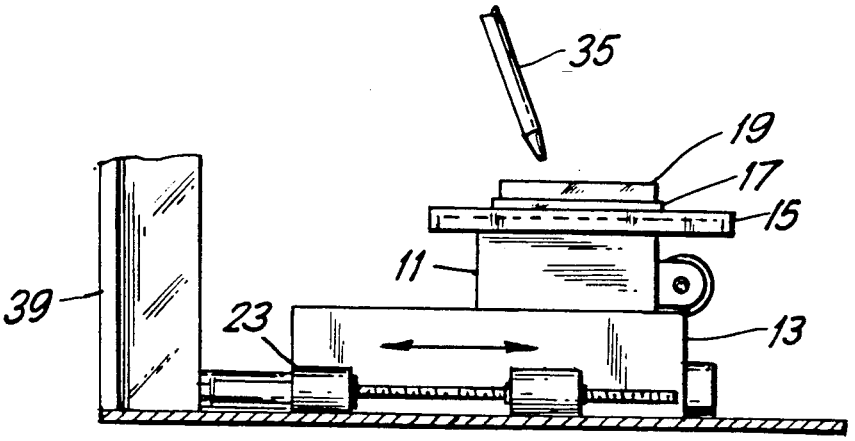
FIG. 4 is a view taken along the lines 4—4 of FIG. 3.

Referring to the drawings, there is shown in FIGS. 1–3 a fluid dispenser generally designated as 10 comprising a first linear translation stage or plate 11. A second linear translation stage 13 is mounted below the first linear translation stage 11 at 90 degrees relative thereto. Each of these linear translation stages is adapted to slide on its pair of respective tracks (not shown) and are activated by stepper motors as hereinafter explained.

A platform 15 is mounted on the upper surface 6 of plate 11 and has a frame 17 attached thereto for securely positioning the multi-welled dish or tray 19 used to carry out the desired reactions or assay. The multi-welled dish 19 is typically made of transparent plastic and includes a plurality of discrete equidistantly spaced wells 21 disposed in rows and columns much as in the assay tray described in the aforementioned U.S. Pat. No. 4,681,742. In the embodiment described herein, this multi-welled dish 19 contains 96 discrete wells disposed in eight rows with each row containing 12 wells.

Again referring to FIGS. 1–3, each linear translation stage or plate 11 and 13 has associated therewith a stepper motor for activating the movement of the plates. Thus, the translational motion of the plate 11 is effected by the stepper motor 23 and the translational motion of the plate 13 is effected by the stepper motor 25. Activation of each stepper motor moves its associated plate into a translational motion in the horizontal or perpendicular direction, thus resulting in a corresponding translational motion of the multi-welled dish 19.

Referring to FIGS. 1 and 2, the fluid dispenser system of the present invention comprises a syringe 24 of the usual construction, including a plunger 27 having a flange 29 and outlet tip 31 which is connected to a plastic tubing 33, the other end of which is connected to a pipette 35. The pipette 35 is provided with a cap 37 through which the tubing 33 is inserted into the pipette. The pipette 35 may be partially stuffed with cotton if desired in order to maintain the sterility of the fluid medium to be dispensed into the multi-welled dish. If desired, a disposable sterilizing filter (not shown) may be installed in the plastic tubing 33 just upstream of the cap 37. The pipette 35 is pivotally connected to the post 39 by means of the pivot swing arm 41 which is pivoted by the pivot pin 43. A stepper motor 45 activates the plunger 27 of the syringe 25 by means of a screw or worm-like rod 47, one end of which is secured to the stepper motor 45 and the other end of which is attached to the flange 29.

In operation, the multi-welled dish 21 is loaded on the platform 15 by securing the dish in the frame 17. The fluid is introduced into the pipette 35 from a fluid reservoir (not shown). The pipette is then manually swung into its initial position where the tip of the pipette is placed directly in register over the first well 21 in the first row of the dish 19. The stepper motor 45 is then activated to bias the plunger 27 forward through the force of the rotating worm-like rod 47. Forward motion of the plunger 27 forces air, or other gas under pressure, into the plastic tubing 33 and into the pipette 35. By controlling the amount of force exerted by the plunger 27, i.e., by calibrating the stepper motor, care can be taken to deposit precise amount of fluid to fill each well. After the first well 21 in the first row has received its predetermined quantity of fluid, the stepper motor is activated to cause translational motion of the plate 11 in the horizontal direction until the pipette comes into register with the next adjacent well 21 in the second row. Once again by activating the stepper motor 45, a calibrated quantity of fluid is deposited in the well 21. This operation is continued until the calibrated amount of fluid is dispensed into each well in the first row. After each time a well has received its predetermined quantity of fluid, the stepper motor 45 is deactivated and stepper motor 23 activated to cause translational motion of the plate 11 in the horizontal direction to bring the pipette in register with the next adjacent well. When the last well in the first row has been filled, stepper motor 25 is then activated to cause linear translation of the plate 13 in the perpendicular direction so that the pipette is now in register with the next adjacent well 21 in the column. Once the well is filled, the stepper motor 25 is deactivated and stepper motor 23 is started in the reverse direction to cause linear translation of the plate 11 in the horizontal direction, and this procedure is repeated until the second row of wells have been filled with the fluid. When the last well in the second row has been filled, once again the stepper motor 23 is deactivated and stepper motor 25 is started to cause displacement of the well in the vertical direction due to the translational motion of plate 13. Thus, it can readily be seen that this procedure may be repeated until the appropriate amount of fluid has been dispensed into all 96 wells, after which the stepper motor returns the dish to its starting position. At this stage, the multi-welled dish 19 is removed and another one loaded on the frame 17 to repeat the operation with the same or different reagent fluid and pipette.

Figure 5:
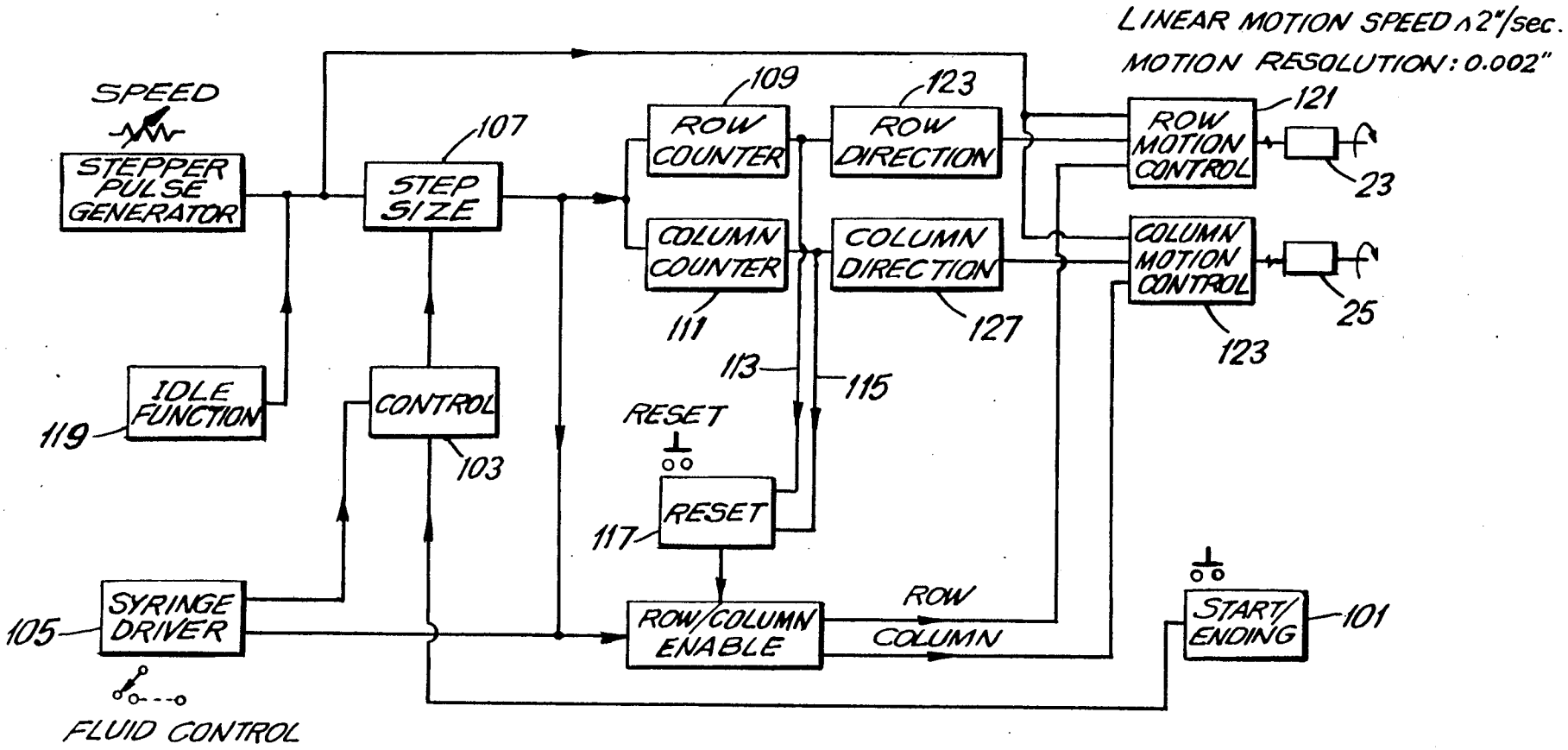
FIG. 5 is a block diagram illustrating the principal controls and operations of the fluid dispenser system of this invention.

The fluid dispenser system and its associated components are electronically controlled and programmed to dispense fluid into the multi-welled dish rapidly and efficiently. Although the details of the electronics associated with the operation of the fluid dispenser are not, per se, part of the present invention, reference to the block diagram in FIG. 5 serves to explain the general principles of operation of the fluid dispenser. Thus, referring to FIG. 5, when the system start button 101 is activated, a signal will be transmitted to the electronic control unit 103 which controls the operations of all the stepper motors. By activating the stepper motor 45 the syringe driver 105 is activated followed by activation of the step size 107 which controls the operation of the stepper motors 23 and 25. When the desired number of rows and columns of the multi-welled dish 19 have been filled, as shown by the row counter 109 and column counter 111, a signal is transmitted from these counters through the signal lines 113, 115 to the reset button 117 in order to repeat the operation for dispensing fluid into another multi-welled dish. Also shown in FIG. 5 is an idle function 119. When the platform 17 positions the dish 19 under the pipette, the idle function insures that the platform is held there until the selected amount of fluid is deposited in the well. Thus, fluid is dispensed from the pipette into the wells during the idling period between displacement of the dish under the pipette. The row motion control 121 and column motion control 123 are biased by the respective stepper motors 23 and 25 to cause the translational motions of each of plates 11 and 13 a finite predetermined distance. The row direction 125 and column direction 127 serve to control the direction of translation of the plates 11 and 13.

From the foregoing detailed description, it is evident that the fluid dispenser system of this invention is easy to sterilize and is readily adaptable to using with different reagent media. Because the fluid medium is first drawn into the pipette from the fluid reservoir, no other parts of the dispenser are contaminated. Also, it can be seen that this fluid dispenser provides a closed system from the syringe to the pipette. Therefore, if it is desired to dispense a different fluid, no cleaning or sterilization is required. All that is necessary is to disconnect the pipette and replace it with another one. This avoids cross-contamination between the fluids in the pipette.

While the invention has been described with a certain degree of particularity, changes and modifications may be made therein which are suggested from the present description. Such changes and modifications are nevertheless within the scope of this invention. It will, for example, be readily apparent to those skilled in the art that the concept of dispensing calibrated quantities of fluid utilizing the system of the invention is not limited to multi-welled receiving units.

What is claimed is:

1. A fluid dispensing system for dispensing fluid into a receptacle having a plurality of spaced apart receiving wells comprising:

(a) a first linearly translatable plate adapted to carry the receptacle;

(b) a second linearly translatable plate mounted below said first linearly translatable plate at 90 degrees relative thereto;

(c) means operatively associated with said first linearly translatable plate to cause a finite predetermined displacement thereof in one direction;

(d) means operatively associated with said second linearly translatable plate to cause a finite predetermined displacement thereof in a second direction;

(e) means for dispensing fluid in each well of said receptacle; and (f) means operatively associated with said fluid dispensing means to cause a predetermined amount of fluid to be dispensed from said fluid dispensing means into each well of said receptacle.

2. A fluid dispensing system as in claim 1 wherein said means which is operatively associated with said first linearly translatable plate and said means which is operatively associated with said second linearly translatable plate is each a reversible stepper motor.

3. A fluid dispensing system as in claim 2 wherein said means for dispensing fluid into each well of said receptacle is a pipette.

4. A fluid dispensing system as in claim 3 wherein said means operatively associated with said fluid dispensing means is a syringe.

5. A fluid dispensity system as in claim 4 wherein said syringe is moved by a stepper motor operatively associated with said syringe.

6. A fluid dispensing system as in claim 2 wherein said means operatively associated with said fluid dispensing means is a syringe.

7. A fluid dispensing system as in claim 6 wherein said syringe is moved by stepper motor operatively associated with said syringe.

8. A fluid dispensing system dispensing as in claim 1 wherein said means for dispensing fluid into each well of said receptacle dish is a pipette.

9. A fluid dispensing system as in claim 8 wherein said means operatively associated with said fluid dispensing means is a syringe.

10. A fluid dispensing system as in claim 9 wherein said syringe is moved by a stepper motor operatively associated with said syringe.

11. A fluid dispensing system as in claim 1 wherein said means operatively associated with said fluid dispensing means is a syringe.

12. A fluid dispensing system as in claim 11 wherein said syringe is biased by a stepper motor operatively associated with said syringe.

13. A fluid dispensing system as in claims 1, 2, 3, 4, 5, 6, 7, 8, 9, 10, 11 or 12 wherein said means operatively associated with said first linearly translatable plate displaces said first plate in a horizontal direction and said means operatively associated with said second linearly translatable plate displaces said second plate in a perpendicular direction.

* * * * *